US006039355A

United States Patent [19]

Durand

[11] Patent Number: 6,039,355

[45] Date of Patent: Mar. 21, 2000

[54] DAILY PLANNING CALENDAR

[76] Inventor: David V. Durand, S60 W24200 Red Wing Dr., Waukesha, Wis. 53186

[21] Appl. No.: 09/312,881

[22] Filed: May 17, 1999

[51] Int. Cl.[7] ..... B42D 5/04

[52] U.S. Cl. ..... 283/2; 283/36; 40/107

[58] Field of Search ..... 281/38, 21.1, 29; 283/2, 3, 4, 36–42; 40/107, 109, 121

[56] References Cited

U.S. PATENT DOCUMENTS

| | | | |
|---|---|---|---|
| 2,684,545 | 7/1954 | Talbot | 40/109 |
| 3,964,195 | 6/1976 | Jordan | 40/107 |
| 4,000,915 | 1/1977 | Strom | 283/36 X |
| 4,232,462 | 11/1980 | Longenecker | 40/119 |
| 4,488,366 | 12/1984 | Hockensmith | 40/119 |
| 4,794,711 | 1/1989 | Christensen | 40/107 |
| 4,798,402 | 1/1989 | Pazicni | 283/2 |
| 4,973,086 | 11/1990 | Donnelly et al. | 283/37 |
| 5,003,713 | 4/1991 | Adany et al. | 40/113 |
| 5,207,580 | 5/1993 | Strecher | 434/238 |
| 5,333,908 | 8/1994 | Dorney et al. | 402/74 X |
| 5,374,083 | 12/1994 | Slocomb | 283/2 |
| 5,690,364 | 11/1997 | Oleske et al. | 283/2 |

*Primary Examiner*—Willmon Fridie, Jr.

*Attorney, Agent, or Firm*—Andrus, Sceales, Starke & Sawall

[57] ABSTRACT

A daily planning calendar for recording daily appointments and non-work related goals in several lifestyle balance categories. The daily planning calendar includes a monthly planning page for each month of the year. Each of the monthly planning pages includes pre-labeled information zones related to non-work related lifestyle balance categories. Additionally, each monthly planning page includes a calendar portion that visually represents the current month. The daily planning calendar further includes a reduced height daily planning page for each day of the year. Each daily planning page includes a detachable daily summary portion including pre-labeled information zones related to the lifestyle balance categories. The daily planning calendar further includes a weekly planning page for each week. The weekly planning page includes a detachable weekly summary portion that displays appointments for the present week on the front face surface and includes pre-labeled information zones on the back face surface for recording weekly goals related to the lifestyle balance categories. The daily planning calendar allows the user to view daily, monthly and weekly appointment summaries as well as non-work related goals in each of the plurality of lifestyle balance categories.

16 Claims, 6 Drawing Sheets

DAILY PLANNING CALENDAR

BACKGROUND OF THE INVENTION

The present invention generally relates to a daily planning calendar. More specifically, the present invention relates to a daily planning calendar that allows the user to continuously and simultaneously view both a weekly summary portion and a monthly summary portion and provides information zones to record personal, non-work related goals in several pre-printed lifestyle balance categories.

Many types of daily planning calendars have been developed to aid busy business professionals in recording and organizing numerous business meetings and appointments in an orderly and presentable manner. Most of these daily planning calendars include numerous lines or areas with time labels that allow the user to record meetings and appointments along the timeline to visually indicate when the meetings and appointments will occur. Additionally, many daily planning calendars include blank areas that allow the user to jot down and record various notes as the day progresses.

In typical daily planning calendars, the user is able to view the current day and possibly the current month, previous month and upcoming month at a glance. The monthly calendar is typically printed on the top or backside of each daily page so that the user can view the upcoming month and make plans accordingly.

Daily planning calendars are typically designed strictly for a single purpose use, such as business planning. In these type of calendar systems, the individual pages are laid out to optimize the business related functionality of the daily planning calendar. However, currently available daily planning calendars do not include any type of recording or reminder system to help the user focus on important goals and concerns that are non-work related. When using this type of calendar, the user is only reminded of work-related concerns and often forgets about other important interests that are required to provide balance in the user's life.

It is therefore an object of the present invention to provide a daily planning calendar that allows the user to continuously and simultaneously view a daily, monthly and weekly summary at a glance. It is an additional object of the invention to provide a daily planning calendar that includes labeled information zones related to non-work related lifestyle balance categories. It is a further object of the invention to include information zones related to the lifestyle balance categories for daily, weekly and monthly goals that can be recorded and are continuously visible to remind the user of these important lifestyle balance categories. It is a further object of he invention to provide a daily planning calendar that includes removable weekly and daily summary portions including information zones related to the lifestyle balance categories.

Various other features, objects and advantages of the invention will be made apparent from the following description taken together with the drawings.

SUMMARY OF THE INVENTION

The present invention is a daily planning calendar that includes information zones that prompt the calendar user to think about and record notes and information related to numerous lifestyle balance categories.

The daily planning calendar includes a monthly planning page for each month of the year. The monthly planning page is a full-sized page including a plurality of monthly information zones contained on the lower area of the page and a calendar portion contained on the upper area of the page. The calendar portion is preferably contained on the upper one-third of the page and includes a visual representation of the present month. The monthly information zones contained on the lower area of the monthly planning page each include a label directed to one of a plurality of individual lifestyle balance categories. The monthly information zones identified by the lifestyle balance categories allow the user to jot down notes related to goals the user wishes to accomplish during the upcoming month.

The daily planning calendar also includes a plurality of individual daily planning pages, each of which correspond to an individual day within the year. Each daily planning page has an overall height less than the height of the monthly planning pages. Specifically, the overall height of the daily planning page is approximately equal to the area of the monthly planning page including the monthly information zones, such that when the daily planning pages are placed upon the monthly planning page, the calendar portion of the monthly planning page is visible above the daily planning pages.

Each of the daily planning pages include an hourly appointment portion and a daily summary portion separated by a series of perforations. The perforations allow the daily summary portion to be detached from the hourly appointment portion. The daily summary portion of each daily planning page includes a plurality of daily information zones each of which includes a label corresponding to one of the lifestyle balance categories. The daily information zones on the daily summary portion provide an area for the user to jot down notes and information related to the lifestyle balance categories during each day. In addition, the labeled daily information zones remind the calendar user to focus on the lifestyle issues identified by the lifestyle balance categories.

The daily planning calendar further includes a weekly planning page for each week of the calendar year. Each weekly planning page is printed to represent the last day of the present week and includes a daily planning portion and a weekly summary portion. The combination of the daily planning portion and the weekly summary portion define the overall height of the weekly planning page, which is approximately equal to the height of monthly planning pages. The weekly summary portion of each weekly planning page is separated from the daily planning portion by a series of perforations such that the user can remove the weekly summary portion after the week has been completed. When the weekly summary portion is removed, the reduced height of the weekly planning page allows the user to view both the weekly summary portion of the weekly planning page for the upcoming week and the calendar portion of the monthly planning page.

The back face surface of the weekly planning page includes a weekly balance point reflection portion including a plurality of weekly information zones each identified by a label corresponding to one of the lifestyle balance categories. The weekly balance point reflection portion allows the calendar user to record notes and comments related to the lifestyle balance categories on a weekly basis.

The daily planning calendar of the present invention includes information zones related to a plurality of lifestyle balance categories that are positioned in a manner to remind the calendar user to recognize the importance of these lifestyle balance categories during their time at work. The information zones are organized such that the calendar user can record information on a monthly, weekly and daily basis within the pages of the daily planning calendar. At all times, the user is able to view at least one portion of the calendar that includes the lifestyle balance categories to continually remind the user of their importance.

BRIEF DESCRIPTION OF THE DRAWINGS

The drawings illustrate the best mode presently contemplated of carrying out the invention.

In the drawings.

DETAILED DESCRIPTION OF THE INVENTION

Figure 1:
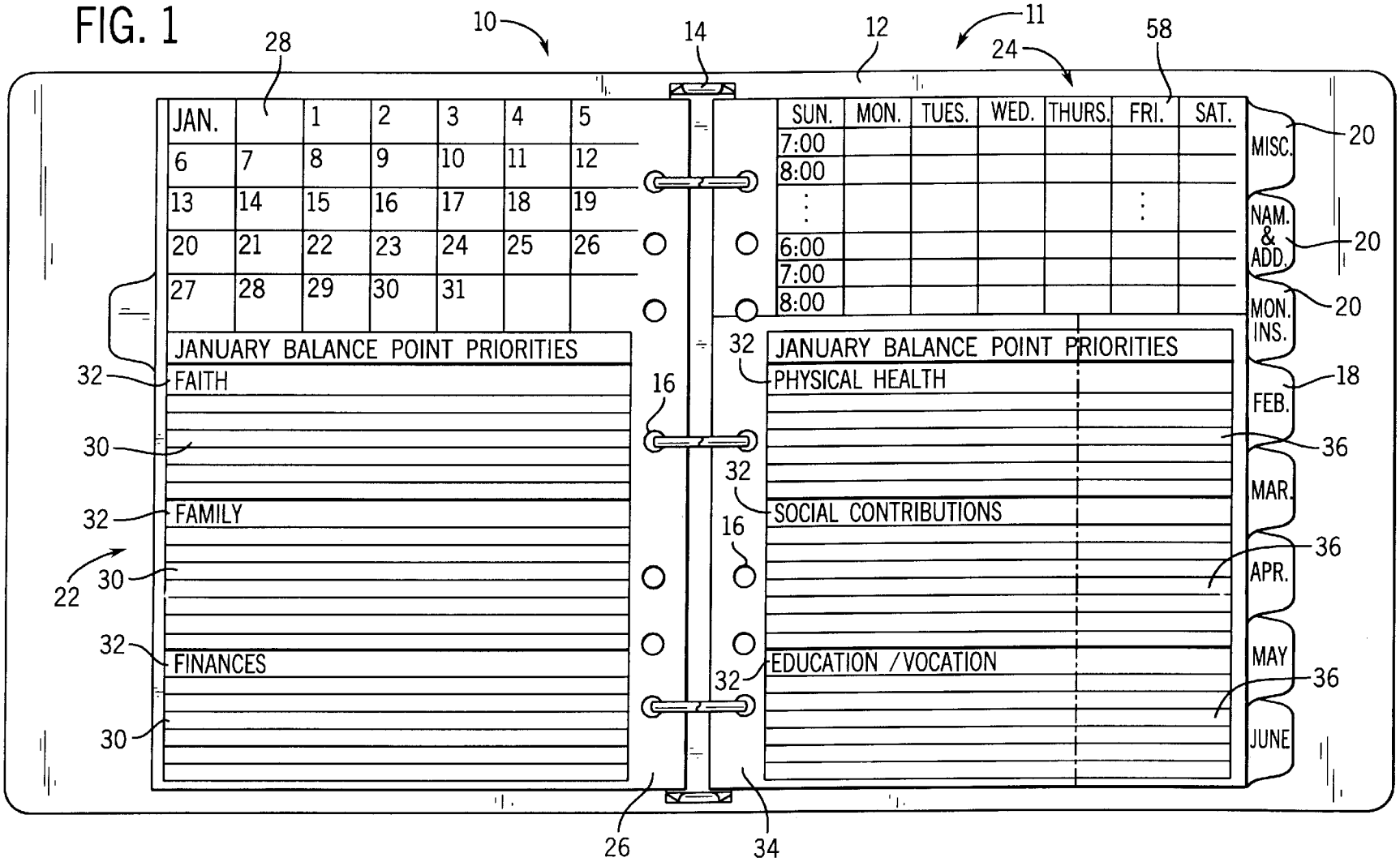
FIG. 1 illustrates a daily planning calendar of the present invention opened to the first month of the year and showing a monthly planning page.

Referring now to the figures, a daily planning calendar of the present invention is generally illustrated by reference numeral 10. The daily planning calendar 10 is shown contained within a three-ring binder 11 having a cover 12 and three-ring retainer 14. The daily planning calendar 10 of the present invention includes a plurality of individual pages each having pre-punched holes 16 that allow the individual pages to be retained and turned within the three ring binder 11 shown, or other equivalent binder-type member. As shown in FIG. 1, the daily planning calendar 10 includes a plurality of individual monthly tabs 18 attached to a divider to separate the individual pages of the calendar into monthly sections. In addition to the monthly tabs 18, information tabs 20 identify the other types of individual pages that are contained within the daily planning calendar 10 of the present invention.

Referring first to FIG. 1, the daily planning calendar 10 is shown as opened to the first month of the calendar year. When the daily planning calendar 10 is opened, both a left page 22 and right page 24 are visible to the user. As shown in FIG. 1, the left page 22 is a monthly planning page 26. The monthly planning page 26 is a continuous sheet having a height generally corresponding to the height of the three-ring binder 11. In the preferred of the invention, the monthly planning page 26 is a sheet of 8½×11 paper.

The monthly planning page 26 generally includes a calendar portion 28 printed on the upper one-third of the monthly planning page 26. The calendar portion 28 includes a visual representation of the days and weeks of the current month. In the example shown in FIG. 1, the days and weeks for January of 1999 are shown. A monthly planning page 26 is included in the daily planning calendar 10 for each individual month of the current year. As can be understood, each monthly planning page 26 includes the distinct calendar portion 28 that illustrates the days and weeks of the month being displayed.

Printed below the calendar portion 28 of the monthly planning page 26 are a plurality of monthly information zones 30. Each of the monthly information zones 30 includes a generally blank area having a series of lines such that the user can record information in each of these monthly information zones 30. As shown in FIG. 1, each of the monthly information zones 30 is positioned below a pre-printed label 32 that corresponds to one of a plurality of lifestyle balance categories. The lifestyle balance categories represented by the pre-printed labels 32 represent non-work related categories that are important to the daily planning calendar user. The lifestyle balance categories are selected to emphasize non-work related goals that are important to provide the user with a balanced lifestyle outside of his or her work related daily concerns.

As can be seen in FIG. 1, when the daily planning calendar 10 is opened to display the monthly planning page 26 as the left page 22, the back surface of the first daily planning page 34 for the month is displayed as the right page 24. The back surface of the first daily planning page 34 for each month also includes a plurality of monthly information zones 36 each identified by a label 32 corresponding to one of the lifestyle balance categories. Thus, in the embodiment shown in FIG. 1, six separate, individual monthly information zones 30 and 36 are available to record information related to six lifestyle balance categories. In the preferred embodiment of the invention, the lifestyle balance categories include faith, family, finances, physical health, social contributions and education/vocation. While these lifestyle balance categories have been selected for the daily planning calendar 10 of the present invention, it is contemplated by the inventor that these categories could be modified and adjusted based upon different types of users of the daily planning calendar. However, it is important to note that each of the lifestyle balance categories focus on non-work related areas of the user's life. By focusing on these areas, the user of the daily planning calendar 10 is better able to recognize the importance of these areas and can achieve a better lifestyle balance.

Figure 2:
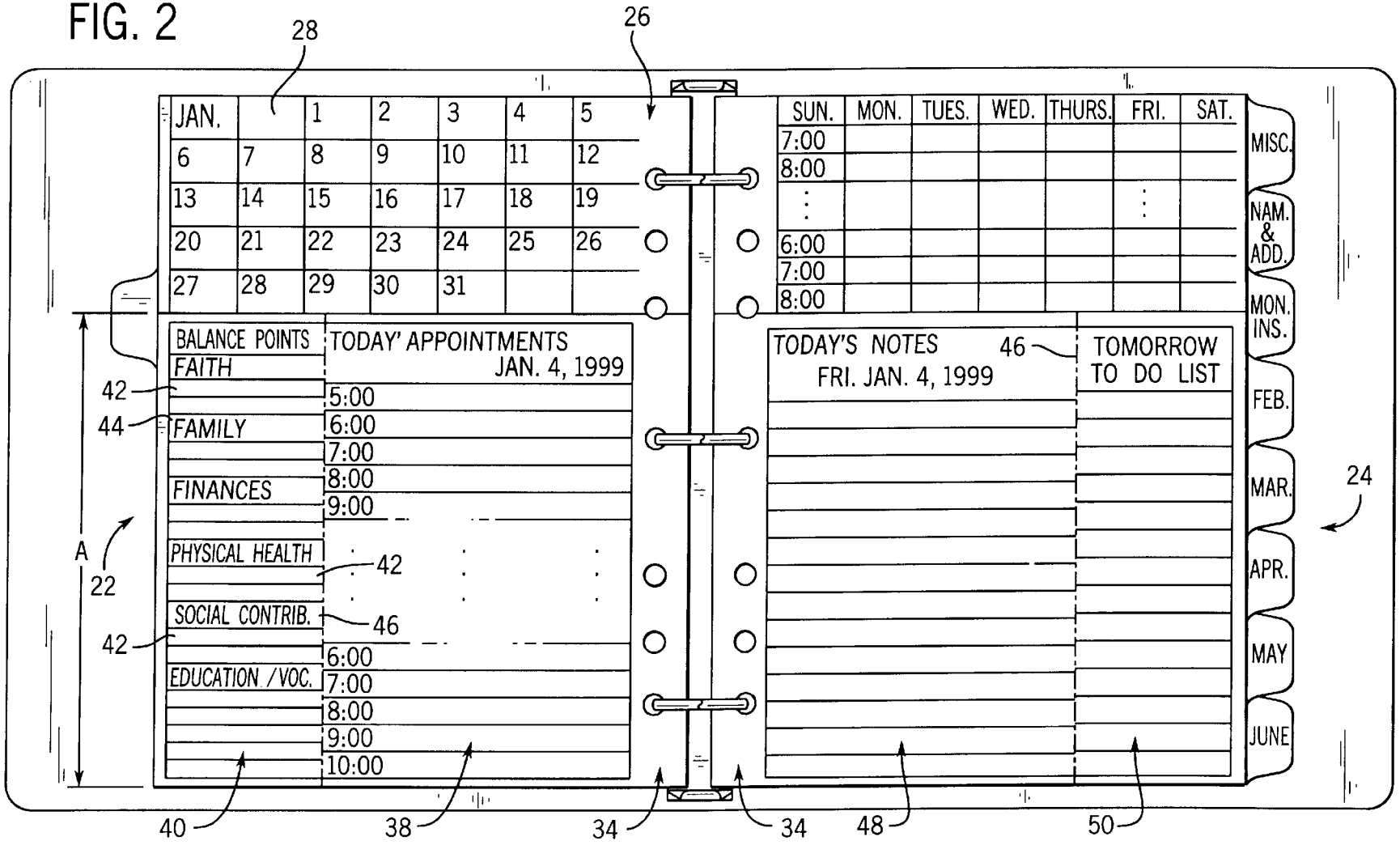
FIG. 2 is a view of the daily planning calendar illustrating a mid-week day shown by a pair of daily planning pages.

Referring now to FIG. 2, the daily planning calendar 10 is shown open such that the left page 22 and the right page 24 each display one of the daily planning pages 34. The daily planning page 34 displayed as the left page 22 allows the user to view the front surface of the daily planning page 34, while the daily planning page 34 displayed as the right page 24 allows the user to view the back surface of the daily planning page 34. As can be seen in FIG. 2, each of the daily planning pages 34 includes information for the current day on its front face surface and contains information related to the previous day on its back face surface. Thus, as each daily planning page 34 is turned from the right page 24 to the left page 22, the page goes from displaying the current day on its back surface to displaying the next day on its front surface. The daily planning calendar 10 includes a daily planning page 34 for each day of the year, such that as the days progress, the user flips through the daily planning calendar 10 to display the current day.

As can be seen in FIG. 2, each daily planning page 34 has a reduced height, referred to by reference character A, compared to the overall height of the monthly planning page 26. In the preferred embodiment of the invention, each daily planning page 34 is approximately two-thirds the height of the monthly planning page 26. As can be seen in FIG. 2, as daily planning pages 34 are turned and stacked on top of the monthly planning page 26, the calendar portion 28 of the monthly planning page 26 is visible above the daily planning pages 34. Thus, as the user flips through the daily planning pages 34 for the month, the user can continuously and simultaneously view the current day and the current month printed on the calendar portion 28.

As shown in FIG. 2, the front surface of each daily planning page 34 includes an hourly appointment portion 38 and daily summary portion 40. The hourly appointment portion 38 includes individual lines corresponding to an hourly timeline representing a normal work day. Thus, in a conventional manner, the user can record and plan daily meetings and appointments based upon the hourly timeline contained in the hourly appointment portion 38.

The daily summary portion 40 on each daily planning page 34 includes a plurality of daily information zones 42 each having a label 44 corresponding to one of the previously identified lifestyle balance categories. The daily information zones 42 contained on the daily summary portion 40 for each daily planning page 34 allow the user to make notes and set goals related to each of the lifestyle balance categories identified by the labels 44. Since the daily summary portion 40 is visible for each day, the user is continuously reminded to address the lifestyle issues represented by each of the lifestyle balance categories.

A series of perforations 46 extend between the hourly appointment portion 38 and daily summary portion 40 such that the daily summary portion 40 can be detached from the hourly appointment portion 38. It is contemplated by the inventor that the detached daily summary portion 40 including the daily information zones 42 corresponding to the lifestyle balance categories can be collected and saved so that the user can identify how he or she has addressed the lifestyle balance categories on a daily basis.

Figure 3:
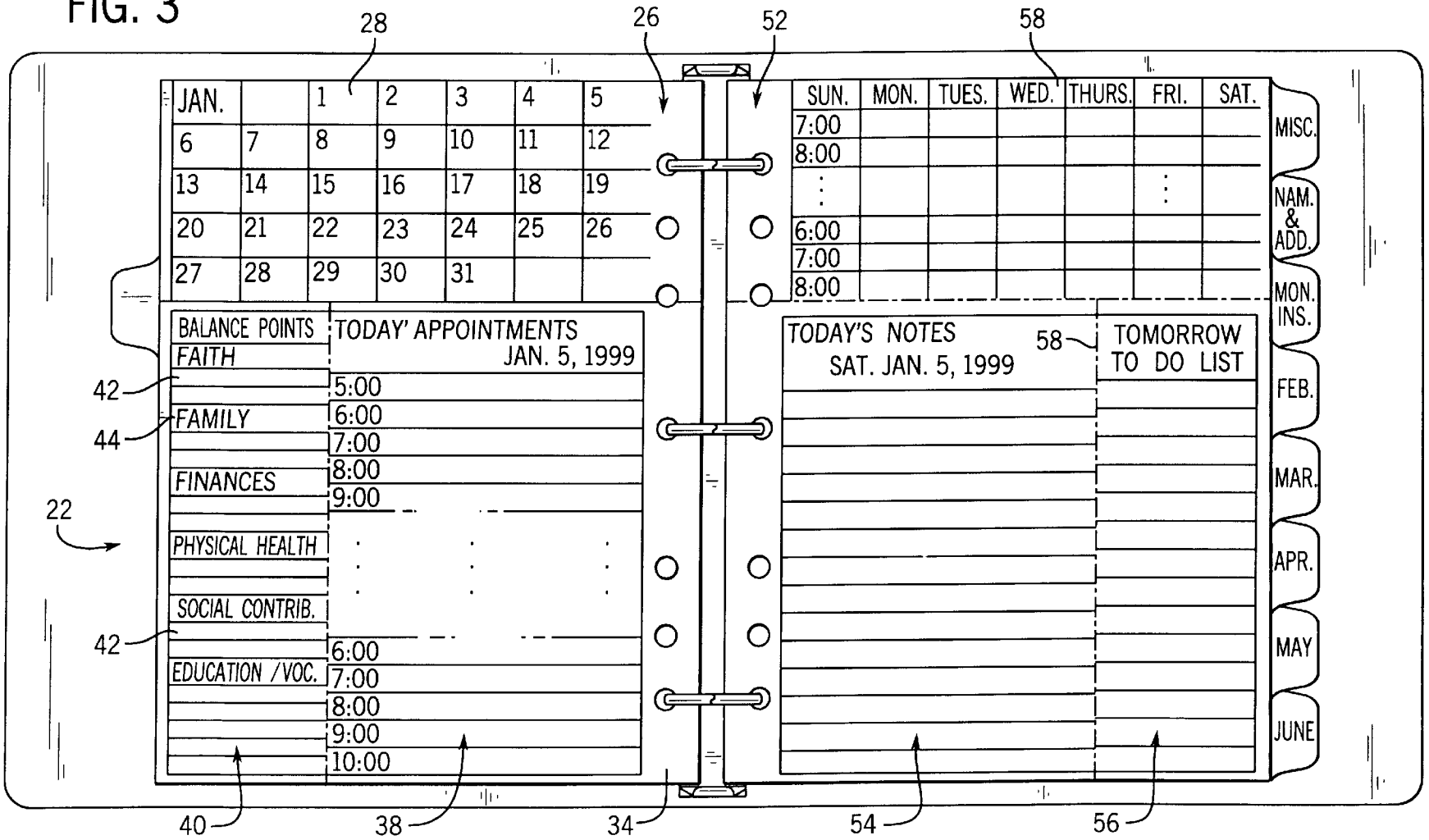
FIG. 3 is a view of the daily planning calendar open to the last day of a week and illustrating one of the weekly planning pages including a removable weekly summary portion.

Referring now to FIGS. 2 and 3, the same daily planning page 34 is shown as the left page 22 in FIG. 3 and the right page 24 in FIG. 2. Specifically, the front surface of the daily planning page 34 is shown as the left page 22 in FIG. 3, while the back surface is shown as the right page 24 in FIG. 2. As can be understood, the front surface for each daily planning page 34 represents the current day, while the back surface of the same daily planning page 34 represents the previous day. The back surface of each daily planning page 34 includes a note portion 48 and a to-do list portion 50. Both the note portion 48 and the to-do list portion 50 include generally blank lines that allow the user to jot down notes and specific items that need to be done the next day. Since the to-do list portion 50 is printed on the back side of the daily summary portion 40, the to-do list portion 50 is detachable along the perforations 46.

Figure 4:
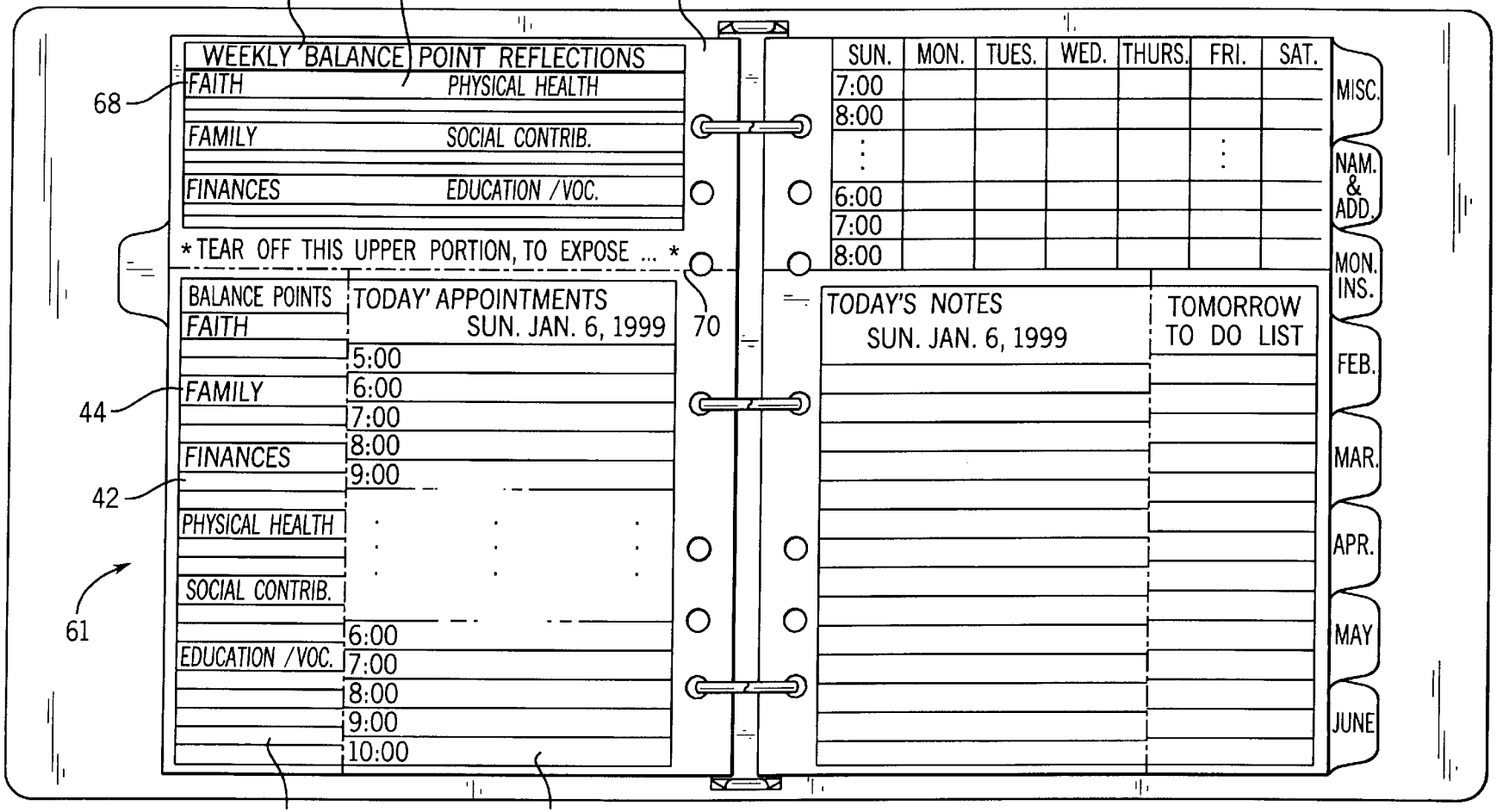
FIG. 4 is a view of the daily planning calendar illustrating the back surface of the weekly planning page including a removable weekly reflection portion.

The front and back surfaces of a weekly planning page 52 are shown in FIGS. 3 and 4. The front surface of the weekly planning page 52 is shown as the left page of FIG. 4, while the back surface of the weekly planning page 52 is shown as the right page in FIG. 3. Referring first to the back surface of the weekly planning page 52 shown in FIG. 3, the back surface includes a note portion 54 and a to-do list portion 56 that are identical to the note portion 48 and the to-do list portion 50 contained on each of the daily planning pages 34. Like the daily planning pages 34, the note portion 54 and the to-do list portion 56 are separated by a series of perforations 58.

The upper area of the back surface of the weekly planning page 52 includes a weekly summary portion 58 (FIG. 3) that includes a preprinted display of the week along with information areas corresponding to a timeline. The weekly summary portion 58 allows the user to jot down important notes on a weekly basis. Referring back to FIG. 1, the weekly summary portion 58 of the weekly planning page 52 is visible above the individual daily planning pages 34 stacked on top of weekly planning page 52. In the preferred embodiment of the invention, the weekly summary portion 58 comprises approximately the upper one-third of each weekly planning page 52 such that it is visible above the reduced height daily planning pages 34.

Referring now to FIG. 4, the front surface of the weekly planning page 52 includes a daily planning portion 61 including an hourly appointment portion 60 and a daily summary portion 62. The hourly appointment portion 60 and the daily summary portion 62 contained on the daily planning portion 61 of each of the weekly planning pages 52 are identical to the hourly appointment portion 38 and the daily summary portion 40 contained on each of the daily planning pages 34. Specifically, the daily summary portion 62 includes the plurality of daily information zones 42 each identified by a lifestyle balance category label 44.

The upper area of the weekly planning page 52 includes a weekly balance point reflection portion 64 that includes a plurality of weekly information zones 66 each identified by a label 68 corresponding to one of the lifestyle balance categories. The weekly information zones 66 allow the user to record goals related to the lifestyle balance categories on a weekly basis. As can be understood by comparing the front and back surfaces of the weekly planning page 52 shown in FIGS. 3 and 4, the weekly balance point reflection portion 64 is printed on the front surface of the weekly planning page 52 in the area corresponding to the weekly summary portion 58 printed on a back surface.

Figure 5:
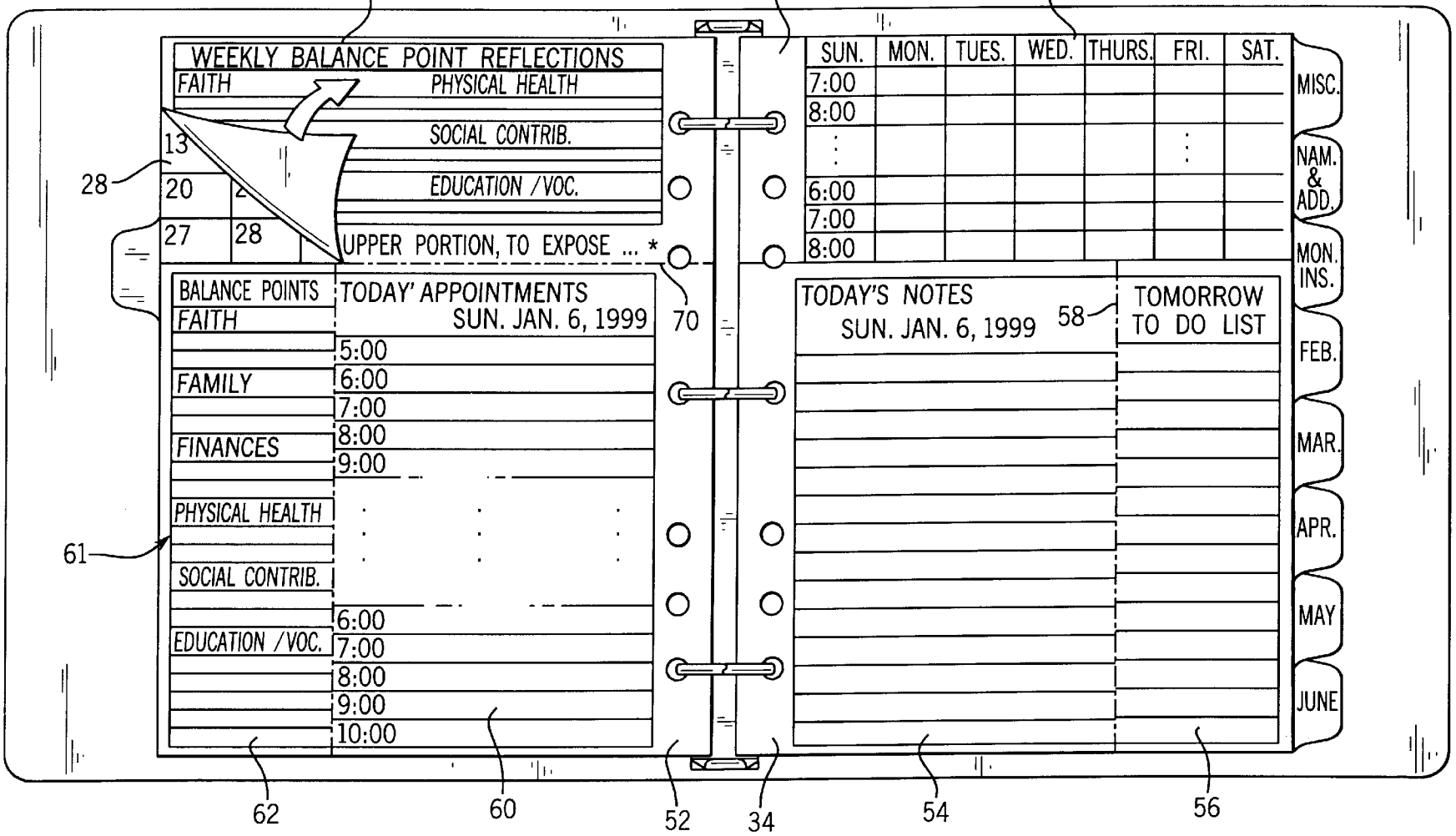
FIG. 5 is a view of the daily planning calendar similar to that shown in FIG. 4 illustrating the detachment of the weekly reflection portion.

The weekly balance point reflection portion 64 is separated from the daily planning portion 61 by a series of perforations 70 such that the weekly balance point reflection portion 64 can be detached from a daily planning portion 61. Specifically, the weekly balance point reflection portion 64 is separated from the daily planning portion 61 after the week shown by the weekly planning page 52 has been completed. As shown in FIG. 5, when the weekly balance point reflection portion 64 is removed, the calendar portion 28 of the monthly planning page 26 for the current month can then be viewed above the daily planning portion 61. At the same time, the weekly summary portion 58 contained on the weekly planning page 52 for the upcoming week is visible above the daily planning pages 34 contained on the right side of the binder. Once the weekly balance point reflection portion 64 has been removed, the user is able to view both the calendar portion 28 displaying the current month and the weekly summary portion 58 displaying the upcoming week.

After the weekly balance point reflection portion 64 has been removed, the user can place the weekly balance point reflection portion 64 in a pocket (not shown) of the three-ring binder 11 and use the accumulated weekly balance point reflection portions 64 from previous weeks to review his or her lifestyle balance. Collecting and reviewing both the weekly balance point reflection portions 64 and daily summary portions 40 allow the user to review their lifestyle balance periodically.

Figure 6:
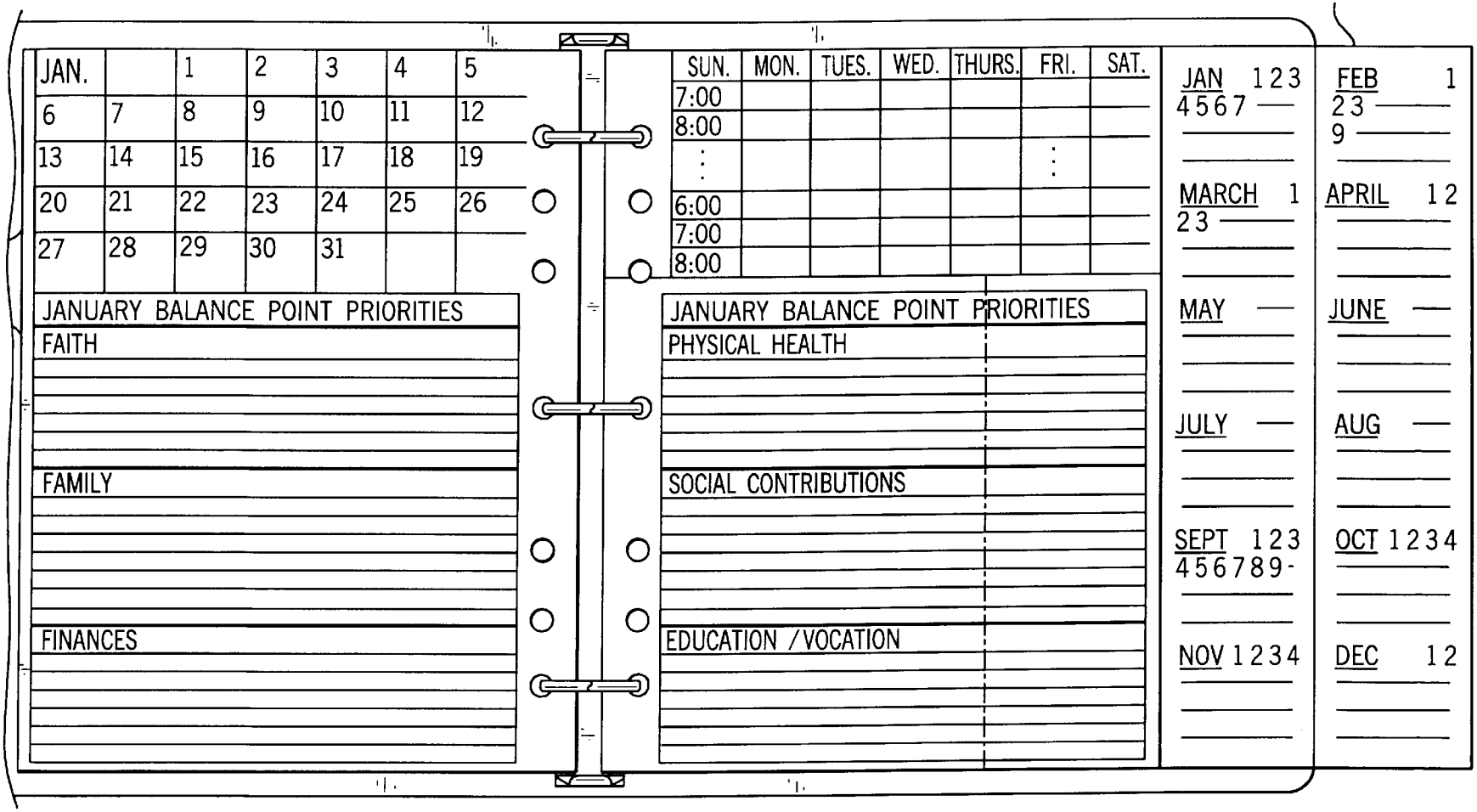
FIG. 6 illustrates the daily planning calendar of the present invention in which a yearly summary portion is extended.

Referring now to FIG. 6, the daily planning calendar further includes a yearly display page having a yearly calendar portion 72 that can be folded out past the edge of the remaining pages to display the days of the current year. The yearly display portion 72 includes a display of each month with the individual days displayed in a conventional calendar format. When the yearly calendar portion 72 pulled it out as shown in FIG. 6, the user of the daily planning calendar 10 is able to view a current day, month, week and year at a single glance. This feature allows the user to quickly and easily make decisions on meeting schedules and appointments without having to flip through various pages within the calendar.

In an additional feature of the invention, it is contemplated by the inventor that each of the lifestyle balance categories contained on the monthly planning page 26, the daily summary portion 40 of the daily planning page 34 and the weekly balance point reflection portion 64 of the weekly planning page 52 could be assigned a specific color. The user would then be instructed to jot down notes and/or goals related to each of the lifestyle balance categories in ink of the particular color assigned to that lifestyle balance category. For example, if the lifestyle balance category of faith were assigned blue, the user would be instructed to jot down all notes and goals related to faith in the color blue. In the embodiment of the invention shown in the figures, six individual lifestyle balance categories are utilized such that the user would be required to write down notes and/or goals in six different colors, depending upon which category the information is related to. Color coding of the lifestyle balance categories allows the user of the daily planning calendar to visually identify which of the categories the goal and/or note is related to without having to read the individual category-based labels.

As can be understood in the previous description, the daily planning calendar 10 of the present invention not only functions to allow the user to make business related appointments and meeting arrangements, but it also functions to focus the user's attention on various lifestyle balance categories that are typically non-work related. At times, the user is presented with a list of the lifestyle balance categories. The lifestyle balance categories emphasize to the user, whom is often times very busy, the importance of maintaining a proper balance between work and non-work related lifestyle areas. By using the daily planning calendar 10 of the present invention, the user is continuously reminded and urged to record information related to each of these lifestyle balance categories. By forcing the user to record this type of information, the user is more likely to maintain a healthy, proper balance in his or her life.

Various alternatives and embodiments are contemplated as being within the scope of the following claims particularly pointing out and distinctly claiming the subject matter regarded as the invention.

I claim:

1. A daily planning calendar including a plurality of individual pages retained within a binder, the calendar comprising:

a plurality of monthly planning pages each representing a month of the year, each monthly planning page including a plurality of monthly information zones and a calendar portion including a visual representation of the current month;

a plurality of daily planning pages each representing a day of the year, each daily planning page having a reduced height relative to the monthly planning pages, such that when the daily planning pages are positioned on top of the monthly planning pages, the calendar portion of the monthly planning page is visible; and a plurality of weekly planning pages each representing the last day of a week, each weekly planning page including a daily planning portion and a weekly summary portion, the weekly summary portion being detachable from the daily planning portion and including a visual representation of the current week, wherein when the weekly summary portion is detached, the daily planning portion has a height equal to the reduced height of the daily planning pages.

2. The daily planning calendar of claim 1 wherein each daily planning page includes a detachable daily summary portion.

3. The daily planning calendar of claim 2 wherein each daily planning page is perforated to permit detachment of the daily summary portion.

4. The daily planning calendar of claim 2 wherein the daily summary portion of each daily planning page includes a plurality of daily information zones, each daily information zone corresponding to one of a plurality of lifestyle balance categories.

5. The daily planning calendar of claim 4 wherein each daily planning page includes a front surface and a back surface, the front surface including the plurality of daily information zones and an hourly appointment portion for the present day, the back surface including a note portion for the preceding day.

6. The daily planning calendar of claim 1 wherein when the current daily planning page is displayed, the calendar portion of the monthly planning page for the current month and the weekly summary portion of the weekly planning page for the current week are both simultaneously visible.

7. The daily planning calendar of claim 1 wherein the plurality of monthly information zones on the monthly planning page each correspond to one of a plurality of lifestyle balance categories.

8. The daily planning calendar of claim 1 wherein each weekly planning page is perforated between the daily planning portion and the weekly summary portion to permit detachment of the weekly summary portion.

9. The daily planning calendar of claim 8 wherein each weekly planning page includes a detachable daily summary portion including a plurality of daily information zones, each daily information zone corresponding to one of a plurality of lifestyle balance categories.

10. The daily planning calendar of claim 8 wherein each weekly planning page includes a front surface and a back surface, the front surface including a plurality of weekly information zones each corresponding to one of the lifestyle balance categories.

11. The daily planning calendar of claim 1 further comprising a yearly planning page including a month display portion including a visual representation of the present year, wherein the month display portion of the yearly planning page extends past an outer edge of the daily planning pages such that when the current daily planning page is displayed, the calendar portion of the monthly planning page for the current month, the weekly summary portion of the weekly planning page for the current week, and the month display portion of the yearly planning page are simultaneously visible.

12. A daily planning calendar including a plurality of individual pages retained within a binder, the calendar comprising:

a monthly planning page for each month of the year, each monthly planning page including a plurality of monthly information zones each corresponding to one of a plurality of lifestyle balance categories for recording monthly goals related to the lifestyle balance categories;

a daily planning page for each day of the year, each daily planning page including a detachable daily summary portion having a plurality of daily information zones each corresponding to one of the lifestyle balance categories for recording daily information related to the lifestyle balance category; and a weekly planning page for each week of the year, each weekly planning page including a weekly reflection portion having a plurality of weekly information zones each corresponding to one of the lifestyle balance categories for recording weekly goals related to the lifestyle balance categories.

13. The daily planning calendar of claim 12 wherein the monthly planning page includes a calendar portion including a visual representation of the current month.

14. The daily planning calendar of claim 13 wherein each daily planning page has a reduced height relative to the monthly planning pages such that when the daily planning pages are positioned on top of the monthly planning page, the calendar portion of the monthly planning page is visible above the daily planning pages.

15. The daily planning calendar of claim 12 wherein the weekly reflection portion of each weekly planning page is contained on a front surface, and each weekly planning page includes a weekly summary portion contained on a back face surface of the weekly planning page opposite the weekly reflection portion, wherein the weekly summary portion is visible above the daily planning pages stacked on the weekly planning page.

16. The daily planning calendar of claim 12 wherein the lifestyle balance categories are non-work related categories.

* * * * *